US005783256A

United States Patent [19]

Matsuda et al.

[11] Patent Number: 5,783,256

[45] Date of Patent: Jul. 21, 1998

[54] PROCESS AND EQUIPMENT FOR THE SIMULTANEOUS RECOVERY OF TWO PIPES OR TUBES WITH A HIGH DEGREE OF OBSTRUCTION

[76] Inventors: Shinichi Matsuda; Kikue Matsuda, both of Rua Cubatão, 966-Apto. 63, São Paulo, Brazil

[21] Appl. No.: 594,530

[22] Filed: Jan. 31, 1996

[51] Int. Cl.[6] ..... B05I 3/00

[52] U.S. Cl. ..... 427/238; 427/230; 427/235; 427/239; 427/290; 427/299; 427/318; 427/386; 427/388.1

[58] Field of Search ..... 427/230, 239, 427/290, 318, 299, 386, 388.1, 238, 235

[56] References Cited

U.S. PATENT DOCUMENTS

| | | | |
|---|---|---|---|
| 4,816,296 | 3/1989 | Gibson | 427/239 |
| 5,499,659 | 3/1996 | Naf | 427/236 |
| 5,622,209 | 4/1997 | Naf | 427/236 |

*Primary Examiner*—Janyce Bell
*Attorney, Agent, or Firm*—Lawrence S. Cohen

[57] ABSTRACT

Patent for "PROCESS AND EQUIPMENT FOR THE SIMULTANEOUS RECOVERY OF TWO PIPES OR TUBES WITH A HIGH DEGREE OF OBSTRUCTION", with the said process consisting of recovering each of the said obstructed pipes or tubes by means of a jet of compressed air flowing with a spiral motion from one of the extremities of each of the said pipes or tubes, with water first being added to the said jet in order to increase the passage of the air; with the said water then being followed by a cleaning solution, a volatile liquid, or another equivalent product, along with an abrasive material consisting of crushed rock or gravel, or a similar substance, in order to clean the said pipe or tube; after which an epoxy resin paint or another type of coating is added, which coats all of the inner wall of the pipe or tube, as a result of the pressure applied by the said jet of compressed air. The corresponding equipment consists of an air-purification device [1] that eliminates the oil and water vapors that were mixed into the jet of compressed air sent by the compressor [5], and that supplies air to two mechanisms [22] that generate spiral jets of compressed air, which flow, likewise with a spiral motion, from the end of the associated mechanisms [into] the two obstructed pipes or tubes [25], with the said assembly including, for each of the said pipes or tubes [25] to be recovered, specific devices [32] [31] [30] and [33] that supply the above-mentioned spiral flow of compressed air with clean water; with a cleaning solution or volatile liquid; with an abrasive material consisting of crushed rock or gravel, or a similar substance; and an epoxy resin paint or other coating material.

11 Claims, 2 Drawing Sheets

DET. A

B-B

PROCESS AND EQUIPMENT FOR THE SIMULTANEOUS RECOVERY OF TWO PIPES OR TUBES WITH A HIGH DEGREE OF OBSTRUCTION

The present invention relates to a process and to the respective equipment intended for use in the recovery of old pipes or tubes with a high degree of obstruction, by means of cleaning and the application of an internal coating.

As is widely known, pipe or tubes in general that have become highly obstructed have always been considered to be virtually useless thereby leading to their replacement by new units, whenever such an action is possible and economically feasible.

However, it often occurs that, due to a variety of circumstances, the above-mentioned replacement of pipes or tubes with a high degree of obstruction by new units is highly problematical, thereby leading to the implementation of various alternatives, such as the injection of chemical products in order to clear the pipes or tubes, which approach also involves massive expenditures, as well as an extended implementation time.

Therefore, in view of the circumstances described above, and in order to overcome them, a process has been devised, along with the corresponding equipment, in order to recover such pipes or tubes with a high degree of obstruction, by means of which process and through the use of which equipment results are obtained that are extraordinary from the point of view of efficiency in terms of the purpose for which they have been proposed, and that—equally importantly—involve a better and more rational use of working time, with an enviable degree of economy.

Accordingly, the process that is the subject of the present invention utilizes a flow of compressed air in the form of a spiral jet, which flow is provided initially with clean water, for example, such as the water obtained from the public water-supply system, in order to expand the passage of the air, thereby making it possible, in the immediately following stage, to perform the cleaning operation per se, by means of the passage of an abrasive material, such as crushed rock or gravel, or a similar material, with the said expansion of the passage being verifiable by means of the change indicated by a pressure gauge installed in the mechanism that generates the said spiral jet of air.

Accordingly, and in view of the fact that the cleaning operation and the application of an anti-oxidation internal coating in pipes or tubes that are highly obstructed require time, one of the important characteristics of the process and equipment in accordance with the present invention consists of the opportunity they provide for the operations that make up the recovery process to be performed in two pipes or tubes simultaneously, thereby obviously reducing the execution time.

More specifically, the present invention introduces a process for the recover of pipes or tubes with a high degree of obstruction, by means of cleaning and the application of an internal coating, which operations are performed simultaneously in two pipes or tubes. The said process is characterized by the fact that it involves a jet of compressed air flowing with a spiral motion from one of the extremities of the pipes or tubes to be recovered, and by the fact that water, such as the water obtained from the public water-supply system, is first added to the said jet, in order to expand the passage of the air, with the said water being followed, depending on the nature of the incrustations on the inner walls of the pipes or tubes, by a cleaning solution or a volatile liquid added to an abrasive material, such as crushed rock or gravel, or a similar material, and finally by an epoxy resin paint or other coating material.

The present invention also includes the associated equipment for the implementation of the process for the recovery of pipes or tubes with a high degree of obstruction. The said equipment includes a series of specific devices, i.e., a pair of devices that generate the spiral jet of air that flows from one of the ends of each pipe or tube; another device that supplies the clean water; another device that introduces the cleaning solution, volatile liquid, or equivalent product; another device that supplies the abrasive material consisting of crushed rock or gravel, or a similar material; and, finally, a last device that supplies the epoxy resin paint or other coating material, with all of the above-mentioned materials being added to the said spiral flow of compressed air.

In accordance with the said process, and through the use of the above-mentioned equipment, the recovery of pipes or tubes with a high degree of obstruction is achieved by means of the following steps: Initially, through the increase in the passage of air through the said pipes or tubes, by means of clean water, such as the water obtained from the public water-supply system, driven or carried by a jet of air moving in a spiral motion, with the said increase being confirmed by means of an appropriately located pressure gauge. Then the cleaning process itself takes place, through the introduction, into the said spiral jet of air, of an abrasive material consisting of crushed rock or gravel, or a similar material, in conjunction with a cleaning solution or a volatile liquid as an auxiliary element in order to melt and dissolve the viscous incrustations. Finally, the epoxy resin paint or other type of coating is applied.

BRIEF DESCRIPTION OF THE DRAWINGS

The attached drawings illustrate the present invention. In the said drawings,*

*[TRANSLATOR'S NOTE: The drawings were not included with the Portuguese-language text submitted for translation.]

Figure 1:
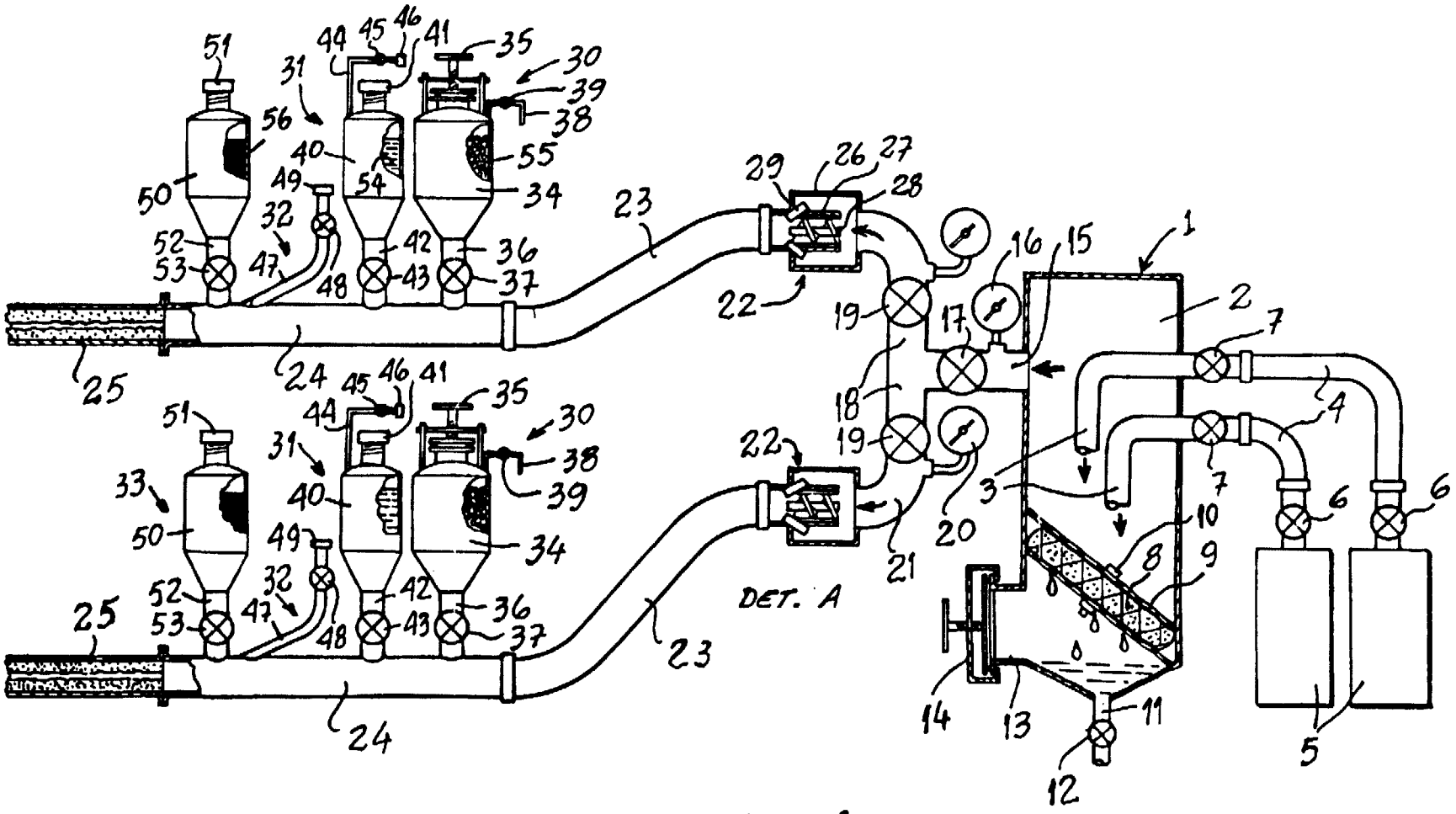
FIG. 1 is a schematic representation of the equipment for the simultaneous recovery of two pipes or tubes with a high degree of obstruction.

As illustrated by the above-mentioned figures, thee equipment for the simultaneous recovery of two pipes or tubes with a high degree of obstruction, which equipment constitutes one of the subjects of the present invention, consists initially (as shown in FIG. 1) of a compressed-air purifier [1], into whose internal air chamber [2] debouch, at the sides and at the top, the downwardly curved ends [3] of a pair of hoses [4] that carry the compressed air from the corresponding air compressors [5], with the valves [6] and [7] controlling the passage of the air, and with the above-mentioned ends [3] resting directly against a highly absorbent sponge [8] that is located at an angle on the immediately lower level and that is supported by a metal framework [9], to which the said air purifier [1] is affixed by means of bolts [10] with nuts, with the said air purifier [1] also having an axial and lower drainage conduit [11], along with a passage-control valve [12], as well as a lower side opening [13] for inspection and cleaning, which opening [13] is also equipped with a removable cap or cover [14].

Accordingly, an outlet conduit [15] is located on the side of the compressed-air purifier [1] opposite the compressed-air supply hoses [4]. The said outlet conduit [15] is equipped with an interpolated pressure gauge [16] and passage-control valve [17], downstream of which the said outlet conduit [15] divides and branches into two other conduits [18] leading toward opposite sides, along with interpolated passage-control valves [19] and pressure gauges [20], with each of the said opposing conduits [18] leading, by means of a curve or bend [21], to a corresponding mechanism [22] that generates the spiral jet of air, with the respective output being interconnected, by means of a long hose [23], to a final and long length of straight conduit [24] that receives the multiple various additives, and that is also coupled to one of the obstructed pipes or tubes [25] upon which the recovery operations are to be performed.

Figure 2:
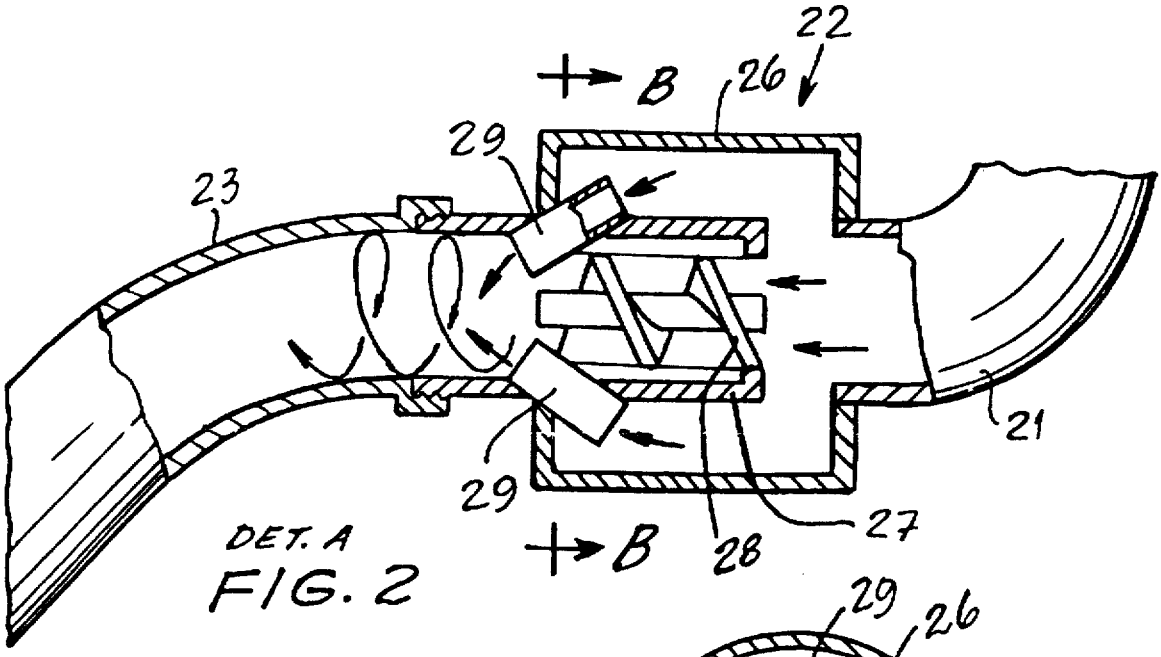
FIG. 2 is an enlarged view of detail "A" in FIG. 1.
Figure 3:
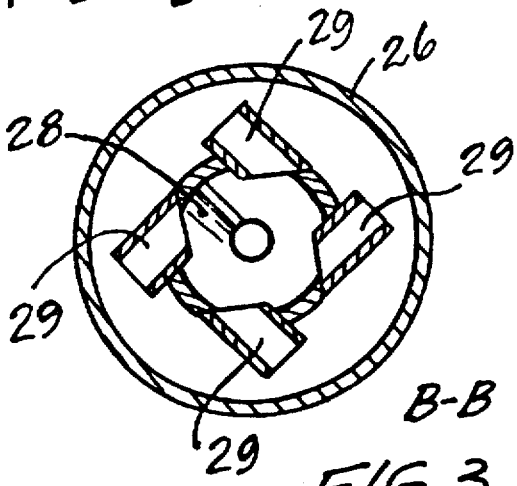
FIG. 3 is a cross-sectional view along line B—B in FIG. 2.

With regard to the mechanisms [22] that generate the spiral jet of air and that form part of the means for the recovery of obstructed pipes or tubes, as shown in FIG. 2, each of the said mechanisms [22] consists of an air-regulation chamber [26] located between the entry curve or bend [21] for the compressed air coming from the [air] purifier [1] and the lose [23] that carries the exiting spiral jet to the length of tubing [24] that receives the multiple various additives, with the said regulation chamber [26] including internally an axial conduit [27] that forms a wrapper or covering for a spiral device [28], with the outlet end being surrounded by short tangential nozzles [29] that are angled toward the central portion of the air-regulation chamber [26].

With regard now to the lengths of tubing [24] that receive the multiple various additives, as shown in FIG. 1, each of the said lengths of tubing [24] receives, in series along the extent of its longitudinal length, an assembly [30] that supplies the abrasive material; an assembly [31 ] that supplies the cleaning solution, volatile liquid, or other equivalent product; an assembly [32] that supplies the clean water; and an assembly [33] that supplies the coating paint.

With regard now to the assemblies [30] that supply the abrasive material, each of the said assemblies includes a reservoir [34] for the abrasive material, with an upper axial opening [35] for loading, and a likewise axial but lower opening [36] for the corresponding length of tubing [24] that receives the additives, which tubing is equipped with a passage-control valve [37], with the said reservoir [34] also being equipped with a thin upper tube [38], which is likewise equipped with a passage-control valve [39], for the discharge of any residual compressed air from the interior of the said reservoir [34].

In turn, each of the assemblies [31] that supply the cleaning solution, volatile liquid, or similar product likewise includes a reservoir [40] for the cleaning solution, volatile liquid, or similar product, with an upper axial opening [41 ] for loading, and a likewise axial but lower opening [42] for the corresponding length of tubing [24] that receives the additives, which tubing is equipped with a passage-control valve [37], with the said reservoir [40] also being equipped with a thin upper tube [44] which is likewise equipped with a passage-control valve [45], and an end-connector [46] for use in coupling the said reservoir to other supply devices, in the event of the continuous use of a solution consisting of the said products.

Each of the assemblies [32] that supply the clean water simply includes a length of conduit or tubing [47] that carries the water to the corresponding tubing [24] that receives the additives, likewise with a passage-control valve [48] and an end-connector [49] for the connection with the supply source.

Finally, the set of equipment described above is completed by the assemblies [33] that supply the coating paint. Each of the said assemblies includes a reservoir [50] for the coating paint, with an upper axial opening [51] for loading, and a likewise axial but lower opening [52] for the corresponding length of tubing [24] that receives the additives, which tubing is equipped with a passage-control valve [53].

With the equipment described above, the process for the simultaneous recovery of two pipes or tubes [25], which are properly coupled to the free ends of the corresponding lengths of tubing [24] that receive the multiple various additives, is implemented in accordance with the procedure described below.

The compressed air supplied by the external compressors [5] and carried by the hoses [4] (naturally, with the appropriate controls, as implemented by means of the valves [6] and [7]) enters the purifier [1] and is discharged into the internal chamber [2] of the said purifier by the downwardly curved ends [3] of the said hoses, directly onto the highly absorbent sponge [8]. The droplets of water exiting from the said sponge are discharged through the lower axial drainage conduit [11], passing naturally through the passage-control valve [12]. The pressure gauge [16], which is located immediately downstream of the upper lateral outlet [15] of the purifier [1], makes it possible to check and confirm the degree of retention of the compressed air within the air chamber [2] of the purifier [1]. Naturally, the cap or cover [14] of the lower side opening [13] of the purifier [1] can be removed so that the said inner chamber [2] can be inspected and cleaned.

Then the valve [17], which is located on the tipper side outlet conduit [15] of the purifier [1], is opened, along with the valves [19] provided on both of the opposing and bifurcated conduits [18] of the said outlet conduit, so that the compressed air is directed, via the respective curved elements [21], from the air chamber [2] of the purifier [1] to the corresponding mechanisms [22] that generate the spiral jet of air, and from the said air-jet generation mechanisms [22], via the corresponding hoses [23] and lengths of tubing [24] that receive the additives, to the obstructed pipes or tubes whose recovery constitutes the purpose of the operations in question.

Figure 4:
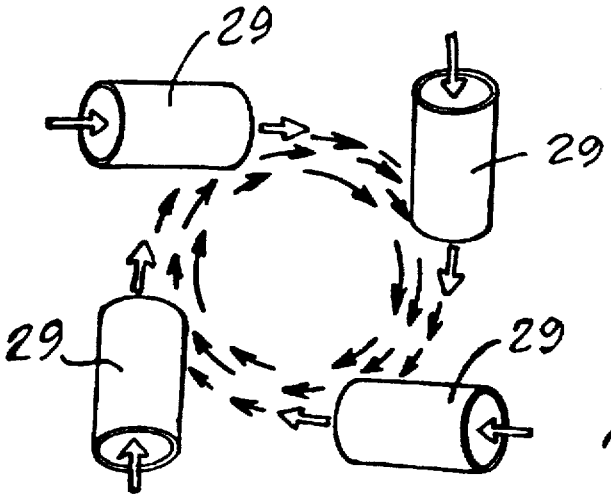
FIG. 4 is a schematic representation of the generation of a spiral stream of compressed air by the equipment in question.

Inside each mechanism [22] that generates a spiral jet of air, the air jet that enters the regulatory chamber [26] is forced to rotate by the spiral device [28] centered inside the said chamber, and the spiral flow of air is then generated and maintained at a given force or strength by the additional jets produced by the short tangential angled nozzles [29] provided at the output of the said regulatory chamber [26], as shown in FIG. 4.

The spiral jet of compressed air formed in the said spiral air-flow generation mechanism [22] is carried by the corresponding hose [23] to the length of tubing [24] that receives the additives. The said spiral jet of compressed air is first combined with the water that comes, by means of the end-connector [49], from the length of conduit [47] in the assembly [32] that supplies the clean water (naturally, with the operation of the respective valve [48]). From there the spiral jet of compressed air and water is carried into the corresponding obstructed pipe or tube [25], in order to enlarge the passage in the said pipe or tube, which passage had been greatly narrowed by the incrustations on its walls.

After the passage in each of the said obstructed pipes or tubes [25] has been properly enlarged, the operation consisting of the cleaning per se of the pipes is performed. In this operation, when the incrustations in the said pipes or tubes are highly viscous and strongly agglutinated, the cleaning solution, volatile liquid, or similar product [54] is added. The said product [54] is provided by the corresponding supply assembly [31] and is added to the abrasive material [55], which is also provided by the corresponding supply assembly [30], arriving naturally, via the respective output conduits [42] and [36], with the appropriate operation of the valves [43] and [37] in the length of tubing [24] that receives the additives, in such a way that the spiral flow of air that passes through the said mixing channel then flows through the entire length of the obstructed pipe or tube [25], removing the incrustations from its walls within a short period of time. The residual compressed air remaining in the reservoir [34] for the abrasive material is discharged into the outside atmosphere by means of the thin upper tube [38], which is fitted with a control valve [39].

Finally, after the simultaneous cleaning and unblocking of both of the pipes or tubes [25] connected to the equipment in question, the interiors of the said pipes or tubes [25] are coated with an epoxy resin paint [56] or a similar coating. The said coating material is provided by the corresponding supply assembly [33] and is carried by the respective outlet conduit [52], with the appropriate operation of the valve [53]. The said coating material is carried directly into the spiral jet of compressed air that is passing through the corresponding length of tubing [24] that receives the additives, and is carried by the said spiral jet of compressed air through the entire length of the unblocked pipe or tube [25], thus perfectly coating the inner surface of the said unblocked pipe or tube [25]. A dust collector (not shown on the drawings) is coupled to the other end of each of the pipes or tubes [25].

As can be seen, the process and the equipment that constitute the subject of the present invention provide a contribution toward the re-use of old and fairly obstructed pipes or tubes, by enabling the incrustations in such pipes or tubes to be removed within a short period of time and then allowing the said pipes or tubes to be coated internally with an epoxy resin paint or another type of coating, thereby making it possible for the said pipes or tubes to be re-used as recycled pipes or tubes.

We claim:

1. Process for the simultaneous recovery of a plurality of pipes or tubes having a high degree of obstruction comprising;

providing a source of compressed air stream from a single conduit;

dividing the source of compressed air stream into a designated conduit for each of said plurality of pipes or tubes;

causing the compressed air stream in each of said designated conduits to have a spiral motion as it proceeds axially through each of said designated conduits defining a spiraling air stream;

directing said spiraling air stream in each designated conduit into a pipe or tube which has a high degree of obstruction;

adding water to said spiraling air stream;

then adding to said spiraling air stream one of;

a) first a cleaning solution or volatile liquid and then an abrasive material;

b) substantially simultaneously a cleaning solution or volatile liquid and an abrasive material, thereby cleaning said pipe or tube;

then, after the aforesaid a) or b) is stopped, adding a coating material to said spiraling air stream.

2. The process of claim 1 further wherein prior to said step of providing a source of compressed air stream from a single conduit;

preparing compressed air by;

passing the air from an air compressor through an absorbent medium for water vapor and oil to remove water vapor and oil from said compressed air; and then passing said compressed air to said single conduit.

3. A process for the simultaneous recovery of two pipes or tubes with a high degree of obstruction comprising;

establishing a first stream of compressed air;

dividing said stream of compressed air into two separate second streams of compressed air;

causing each of said second streams of compressed air to flow in a spiral motion into one of said two pipes or tubes to define two spiralling streams of compressed air;

adding water to each of said spiralling streams of compressed air in such a way that the said water flows through the entire length of the obstructed pipe or tube;

then adding a cleaning solution or a volatile liquid along with an abrasive material to each of said spiralling air streams to cause the said cleaning fluid or volatile liquid and the said abrasive material to pass internally through the entire length of the pipe or tube thereby cleaning it;

then adding a coating fluid to said spiralling air stream causing said coating fluid to pass internally through the entire length of the pipe or tube, coating all of the inner surface thereof.

4. The process of claim 3 further wherein said step of establishing a first stream of compressed air comprises;

passing air from an air compressor through an absorbent medium for water vapor and oil to remove water vapor and oil from said compressed air.

5. A process for the simultaneous treatment for recovery of two pipes or tubes with a high degree of obstruction comprising;

establishing a stream of compressed air flowing with a spiral motion simultaneously into each of said pipes or tubes;

adding water to said stream of compressed air so that the water and compressed air are combined and flow through the length of pipe or tube to be treated;

adding a cleaning solution to said stream of compressed air to flow through the length of pipe or tube being treated;

adding an abrasive to said stream of compressed air to flow through the length of pipe or tube being treated;

after completion and termination of the above treatments of water, cleaning solution and abrasive, adding to the air stream a selected coating material to said stream of compressed air to flow through the length of pipe or tube being treated to coat the inner wall thereof.

6. The process of claim 5 wherein said leaning solution and said abrasive are added simultaneously.

7. The process of claim 5 wherein said cleaning solution includes a volatile liquid.

8. The process of claim 5 wherein said coating material is an epoxy resin material.

9. The process of claim 5 further comprising;

providing a conduit for said stream of compressed air attached to each of said pipes or tubes and a means for introducing each of said treatments including water, cleaning solution, abrasive and coating material selectively into said conduit.

10. The process of claim 9 wherein said means for introducing said treatments are provided by providing an entry means for each of said treatments into said conduit in the order, from further from the pipe or tube to nearer thereto of the abrasive, the cleaning solution, the water and the coating material.

11. The process of claim 9 wherein said means for introducing said treatments are provided by providing an entry means for each of said treatments into said conduit in an order in which the coating material is nearest to the pipe or tube.

* * * * *